US006054424A

United States Patent [19]

Ip

[11] Patent Number: 6,054,424

[45] Date of Patent: Apr. 25, 2000

[54] PROCESS FOR THE PRODUCTION OF A LIQUID LAUNDRY DETERGENT COMPOSITION OF DESIRED VISCOSITY CONTAINING NONIONIC AND ANIONIC SURFACTANTS

[75] Inventor: John Ip, Princeton, N.J.

[73] Assignee: Church & Dwight Co., Inc., Princeton, N.J.

[21] Appl. No.: 09/060,421

[22] Filed: Apr. 15, 1998

[51] Int. Cl.[7] ..... C11D 17/00; C11D 17/08; C11D 1/00

[52] U.S. Cl. ..... 510/421; 510/424; 510/426; 510/428; 510/536

[58] Field of Search ..... 510/303, 424, 510/426, 421, 422, 427, 428, 531, 509, 536

[56] References Cited

U.S. PATENT DOCUMENTS

| | | | |
|---|---|---|---|
| 4,464,292 | 8/1984 | Lengyel | 252/532 |
| 4,842,767 | 6/1989 | Warschewski et al. | 252/525 |
| 5,004,557 | 4/1991 | Nagarajan et al. | 252/174.24 |
| 5,308,530 | 5/1994 | Aronson et al. | 252/174.12 |

*Primary Examiner*—Necholus Ogden
*Attorney, Agent, or Firm*—Irving Fishman

[57] ABSTRACT

A liquid laundry detergent composition of desired viscosity produced by a process comprising dissolving in an aqueous medium a water-soluble builder and a surfactant blend comprising two nonionic surfactants and two anionic surfactants, such as surfactant blend being prepared by partially sulfating and subsequently neutralizing a mixture of two ethoxylated long chain alcohol nonionic surfactants containing different average numbers of ethoxy groups per molecule while employing certain values of the weight ratio of the two nonionic surfactants and the percent conversion of the nonionic surfactants to sulfated anionic surfactants.

11 Claims, No Drawings

PROCESS FOR THE PRODUCTION OF A LIQUID LAUNDRY DETERGENT COMPOSITION OF DESIRED VISCOSITY CONTAINING NONIONIC AND ANIONIC SURFACTANTS

CROSS-REFERENCE TO RELATED APPLICATIONS

Not applicable

STATEMENT REGARDING FEDERALLY SPONSORED RESEARCH AND DEVELOPMENT

Not applicable

BACKGROUND OF THE INVENTION

1. Field of the Invention

This invention relates to a process for producing an aqueous liquid laundry detergent composition of desired viscosity and containing nonionic and anionic surfactants.

2. Description of the Related Art Including Information Disclosed Under 37CFR 1.97 and 1.98.

Laundry detergent compositions are sold as either solid, i.e., powder or granular compositions, or liquid compositions. The advantages of liquid over solid compositions are that the caking tending to occur with solid compositions is avoided, the liquid composition is more easily dispersed in wash water, and a liquid is more easily measured and added to the washing machine without spillage than is a solid composition. In addition, larger percentages of nonionic surfactants can be incorporated in liquid detergents than in powdered detergents, resulting in greater effectiveness of liquid detergents in removing oily and greasy soils.

A class of liquid laundry detergent compositions comprising an aqueous medium in which is dissolved a sodium carbonate builder, a surfactant blend comprising two ethoxylated long chain alcohol nonionic surfactants, and two sulfated ethoxylated long chain alcohol anionic surfactants, one nonionic and anionic surfactant containing a larger average number of ethoxy groups per molecule than the other nonionic and anionic surfactant, has been found to have superior freeze/thaw and high/low temperature stability as well as excellent detergency, i.e., cleaning ability. However, to achieve a viscosity of this type of liquid detergent within certain desirable limits, it is often necessary to incorporate in the composition additional components such as a hydrotrope, e.g., alcohol or sodium xylene sulfonate, or a high molecular weight polymer viscosity control agent, which materials may detract from the otherwise desirable properties of the composition. Thus, any method for achieving a desired viscosity while eliminating or reducing the need for the use in the composition of a hydrotrope and/or polymeric viscosity control agent is very desirable.

U.S. Pat. No. 4,464,292, issued Aug. 7, 1984 to Lengyel, discloses mixtures of an ethoxylated long chain alcohol nonionic surfactant and an ethoxylated long chain alcohol sulfate anionic surfactant for use in laundry detergents. Also disclosed is the preparation of such mixtures by partially sulfating the nonionic surfactant with concentrated sulfuric acid.

U.S. Pat. No. 5,004,557, issued Apr. 2, 1991 to Nagarajan et al., teaches aqueous liquid laundry detergent compositions comprising a surfactant, a water-soluble sequester builder, and 0.1 to 2% of a homopolymer or copolymer of acrylic acid having a molecular weight in excess of 100,000 as an anti-redeposition and viscosity control agent. The surfactant may be anionic such as an alkylbenzenesulfonate, nonionic such as a condensation product of ethylene oxide with a $C_8$–$C_{18}$ primary or secondary aliphatic alcohol, amphoteric such as an N-alkylamino acid, or a combination of such surfactants.

U.S. Pat. No. 5,308,530, issued May 3, 1994 to Aronson et al., discloses a liquid detergent composition comprising a surfactant which may be anionic, nonionic, cationic, zwitterionic or ampholytic, or any combination thereof; a calcium-stabilized enzyme; and as a builder or anti-redeposition agent, a copolymer of an unsaturated carboxylic acid and a hydrophobic monomer prepared by solution polymerization.

Pending U.S. patent application Ser. No. 08/851,034, filed May 5, 1997, discloses and claims liquid laundry detergent compositions comprising a sodium carbonate detergent builder; and a surfactant blend of two anionic surfactants, one of which has the formula $R—O—(CH_2CH_2O)_3SO_3M$ and the other the formula $R—O—(CH_2CH_2O)_7SO_3M$, where R is a $C_{10}$–$C_{16}$ alkyl group and M is an alkali metal or ammonium cation; and two nonionic surfactants, one of which has the formula $R—O—(CH_2CH_2O)_3—H$ and the other the formula $R—O(CH_2CH_2O)_7—H$ where R is a $C_{10}$–$C_{16}$ alkyl group.

Pending U.S. application Ser. No. 08/906,440, filed Aug. 5, 1997, discloses and claims compositions similar to those of Ser. No. 08/851,034 described in the previous paragraph except that the compositions also contain an amphoteric surfactant.

BRIEF SUMMARY OF THE INVENTION

In accordance with this invention, a liquid laundry detergent composition of desired viscosity is produced by a process comprising dissolving in an aqueous medium a water-soluble builder and a surfactant blend comprising two nonionic surfactants and two anionic surfactants, such surfactant blend being prepared by partially sulfating and subsequently neutralizing a mixture of two ethoxylated long chain alcohol nonionic surfactants containing different average numbers of ethoxy groups per molecule, while employing certain values of the weight ratio or "split" of the two nonionic surfactants, and the percent conversion of the nonionic surfactants to sulfated anionic surfactants. These values, which result in a viscosity of the finished detergent formulation within a desired range, are determined by reference to and consistent with preestablished correlations of said ratio and percent conversion with the viscosity of a liquid detergent composition comprising an aqueous solution of the neutralized surfactant blend, indicating that when the percent conversion is increased from lower to higher values at a constant ratio of the two nonionic surfactants, the viscosity increases with the percent conversion, and that when said ratio is increased from lower to higher values at a constant percent conversion, the viscosity rises and reaches a maximum at an intermediate ratio and then falls as the ratio is increased further.

It has been found that when appropriate values of the weight ratio or split of the two nonionic surfactants, and the percent conversion of nonionic surfactants to the anionic sulfates, are employed to obtain a viscosity as close as possible to a desired range consistent with the preestablished correlations discussed previously, the use of such viscosity controlling agents as hydrotropes and/or polymeric carboxylates can be eliminated or reduced.

BRIEF DESCRIPTION OF THE SEVERAL VIEWS OF THE DRAWING

Not applicable

DETAILED DESCRIPTION OF THE INVENTION

The water-soluble detergent builders contemplated in the liquid detergent compositions of the present invention are, for example, the ammonium and alkali metal carbonates, bicarbonates, sesquicarbonates, orthophosphates, tripolyphosphates, pyrophosphates, hexametaphosphates, borates, silicates, citrates, and mixtures thereof. A preferred group of builders are the sodium and potassium carbonates, bicarbonates, sesquicarbonates, and mixtures thereof and particularly preferred is sodium carbonate (soda ash), as the sole builder or in combination with a minor amount of sodium bicarbonate. The builder may be present in the detergent composition in an amount, for example, of about 0.5 to about 12 wt. %, preferably about 0.5 to about 5 wt. %, based on the weight of the final detergent composition, such amount being independent of the amount of any compound suitable as a builder, e.g. sodium carbonate, used to neutralize the sulfated anionic surfactant component.

As stated, the two nonionic surfactants which are partially sulfated to obtain the surfactant blend of the detergent composition of this invention contain different average numbers of ethoxy groups per molecule. The nonionic surfactant containing the smaller number of ethoxy groups (first nonionic surfactant) is an ethoxylated long chain, preferably straight chain, primary or secondary single alcohol or mixture of alcohols, such alcohols containing about 10 to about 16 carbon atoms, preferably about 12 to about 14 carbon atoms, and an average number of about 1 to about 5 ethoxy groups, preferably about 3 ethoxy groups. The first nonionic surfactant thus has the formula $$R—O(CH_2CH_2O)_x—H$$

where R is one or more primary or secondary alkyl groups, preferably straight chain, each having about 10 to about 16 carbon atoms, preferably about 12 to about 14 carbon atoms, and x is an average of about 1 to about 5, preferably about 3.

The nonionic surfactant having the greater number of ethoxy groups (second nonionic surfactant) is similar to the first nonionic surfactant except that the long chain alcohol is a single alcohol or mixture of alcohols containing about 10 to about 16 carbon atoms preferably about 12 to about 14 carbon atoms, and the average number of ethoxy groups per molecule is about 6 to about 12, preferably about 7. The second nonionic surfactant thus has the formula $$R^1O(CH_2CH_2O)_y—H$$

where $R^1$ has the same meaning as R except that the alkyl groups may contain about 10 to about 16 carbon atoms, preferably about 12 to about 16 carbon atoms, and y is an average of about 6 to about 12, preferably about 7.

In preparing the surfactant blend of the detergent compositions of this invention, a mixture of the two nonionic surfactants having a desired weight ratio or split of the first to the second nonionic surfactant is partially sulfated to achieve a desired percent conversion of the nonionic surfactants to the corresponding first and second sulfated anionic surfactants, i.e., the percentage of the original nonionic surfactants which becomes sulfated. The conversion is accomplished by adding an amount of sulfating agent, e.g., concentrated sulfuric acid, to the nonionic surfactant mixture with the desired split, in an amount calculated to react with the amount of such mixture necessary to obtain the desired percent conversion, which may be in the range, for example, of about 30 to about 80%, preferably about 40 to about 60%. The sulfation may be carried out as disclosed, for example, in previously cited U.S. Pat. No. 4,464,292, the entire disclosure of which is incorporated by reference. The partially sulfated mixture is then completely neutralized with an appropriate alkaline compound, e.g., an alkali metal hydroxide or carbonate, or ammonium hydroxide.

In a typical sulfation procedure, a selected nonionic ethoxylated alcohol surfactant mixture is admixed with 96–100% concentrated sulfuric acid, in a proportion of about 0.5 to about 2 moles of sulfuric acid per mole of nonionic ethoxylated alcohol mixture. The exothermic reaction admixture is maintained at a temperature between about 90° to about 150° for a sufficient period between about 0.5 to about 45 minutes to convert about 30 to about 80 weight percent of the initial nonionic surfactant mixture to sulfate ester anionic surfactant derivatives.

The resulting partially sulfated nonionic ethoxylated alcohol surfactant blend is a liquid mixture of residual unsulfated ethoxylated alcohols, and sulfated ethoxylated alcohols, with the possibility of lesser quantities of residual unsulfated unethoxylated alcohols, and sulfated unethoxylated alcohols also being present due to the fact that commercial nonionic ethoxylated alcohol products may contain up to about 20 weight percent of unethoxylated alcohols.

The two sulfated ethoxylated alcohol anionic surfactants present in the partially sulfated mixture have substantially the same alkyl and ethoxy group profile as the corresponding unsulfated nonionic surfactants, so that the general formulas of the first and second anionic surfactants after neutralization of the sulfated compounds are as follows $$R—O—(CH_2CH_2O)_x—SO_3M$$

and $$R^1O—(CH_2CH_2O)_y—SO_3M$$

where R, $R^1$, x and y have the same meanings as in the general formulas for the corresponding nonionic surfactants, and M is an alkali metal or ammonium cation.

The total surfactant blend may be present in the liquid detergent composition in an amount, for example, of about 5 to about 60 wt. % preferably about 8 to about 30 wt. %, based on the weight of the total detergent composition with each of the two nonionic and two anionic surfactants being present in amount of about 5 to about 55 wt. % based on the weight of the surfactant blend. This translates to a weight ratio or split of first to second nonionic surfactant in the mixture subjected to partial sulfation, of about 1/11 to about 11/1. Preferably the split is from about 25/75 to about 75/25 and most preferably from about 30/70 to about 70/30.

Optionally, the liquid detergent composition of this invention may contain an at least partially neutralized carboxylic acid containing polymer as a soil anti-redeposition agent. The carboxylic acid-containing polymer (before partial or complete neutralization) may be, for example, a homopolymer or copolymer (composed of two or more comonomers) of an α,β-monoethylenically unsaturated acid monomer containing no more than nine, preferably no more than seven carbon atoms, such as acrylic acid, methacrylic acid, a diacid such as maleic acid, itaconic acid, fumaric acid, mesoconic acid, citraconic acid and the like, a monoester of a diacid with an alkanol, e.g., having 1–5 carbon atoms, and mixtures thereof. In addition to a homopolymer, the polymer may be, for example, a copolymer of monomers consisting of more than one of the foregoing unsaturated carboxylic acid monomers, e.g., acrylic acid and maleic acid, or a copolymer of monomers consisting of at least one of such unsaturated carboxylic acid monomers with at least one noncarboxylic acid, α,β-monoethylenically unsaturated monomer containing no more than nine, preferably no more than seven carbon atoms, which may be either non-polar such as styrene or an olefin, such as ethylene, propylene or butene-1, or which has a polar functional group, such as vinyl acetate, vinyl chloride, vinyl alcohol, an alkyl acrylate, vinyl pyridine, vinyl pyrrolidone, or an amide of one of the delineated unsaturated acid monomers, such as acrylamide or methacrylamide. Certain of the foregoing copolymers may be prepared by aftertreating a homopolymer or a different copolymer, e.g., a copolymer of acrylic acid and acrylamide may be produced by partially hydrolyzing a polyacrylamide.

Copolymers of monomers consisting of at least one unsaturated carboxylic acid monomer with at least one non-carboxylic acid comonomer should contain at least about 50 mol % of the polymerized carboxylic acid monomer.

Particularly preferred carboxylic acid-containing polymers are homopolymers of one of the foregoing unsaturated carboxylic acids and copolymers of monomers consisting of more than one of such unsaturated carboxylic acids; more preferred are copolymers of about 50 to about 95 wt. % of acrylic acid and about 5 to about 50 wt. % of maleic acid based on the weight of the copolymer.

The carboxylic acid-containing polymer has a number average molecular weight of, for example, up to about 10,000, preferably about 1000 to about 10,000, and more preferably about 2000 to about 5000. To ensure substantial water solubility, the polymer may be completely or partially neutralized, e.g., with alkali metal ions, preferably sodium ions, before being combined with the other components of the composition.

If used, the carboxylic acid-containing polymer may be present in an amount, for example, of about 0.025 to about 1.9 wt. %, preferably about 0.05 to about 0.9 wt. %, calculated as solid unneutralized polymer and based on the total weight of the detergent composition.

In addition to the foregoing components, various conventional water-soluble adjuvants of liquid laundry detergents may optionally also be present, such as, for example, chelating agents such as salts of EDTA, e.g., $Na_4EDTA$, fatty acid salts, e.g. alkali metal oleates, lather boosters such as alkanolamines, lather depressants such as alkyl phosphates or silicones, soaps, fabric softening agents, optical brighteners such as fluorescent agents, perfumes, enzymes, germicides, colorants such as dyes, and the like.

All of the contemplated components are dissolved or dispersed in water which is present in the final composition in an amount of, for example, about 30 to about 95 wt. %, preferably about 50 to about 92 wt. %, and more preferably about 70 to about 90 wt. %, based on the total weight of the composition.

The following experiments illustrate the procedure for the preestablishment of correlations used under this invention to determine the combination of the values of the ratio or split of the first to the second nonionic surfactants subjected to partial sulfation and the percent conversion to sulfates, to obtain a viscosity of liquid detergent composition within a desired range.

EXPERIMENTS 1–5

These experiments show the establishment of the correlation between the viscosity of a typical formulation of a liquid detergent composition containing a sodium carbonate (soda ash) builder and a surfactant component contemplated under this invention, and variations in the value of the percent conversion of the contemplated nonionic compounds to the anionic sulfates of such nonionic compounds, while keeping the split or weight ratio of the two nonionic surfactants at a constant value of 60/40.

Varying amounts of a first nonionic surfactant (Non.Surf. (1)) in which the "R" of the general formula, derived from the alcohol subjected to ethoxylation, was primary straight chain (linear) alkyl containing from about 12 to about 14 carbon atoms, the value of "x", i.e., the average number of ethoxy groups per atom, was about 3, and the molecular weight was about 327; a second nonionic surfactant (Non. Surf. (2)) in which "$R^1$" of the general formula was primary straight chain alkyl containing from about 12 to about 16 carbon atoms, the value of "y" was about 7, (the weight ratio or split of first to second nonionic surfactant being kept constant at 60/40); and 99% concentrated sulfuric acid ($H_2SO_4$), were mixed at a temperature below 130° F. for a minimum of 10 minutes to obtain a partially sulfated surfactant premix (Surf. Premix) containing first and second nonionic surfactants (Non. Surf. (1) and Non. Surf. (2)) having substantially the same split as the original mixture subjected to partial sulfation, and sulfated anionic surfactants (An. Surf. (1) and An. Surf. (2)) in amounts resulting from the partial sulfation. Table I shows for each experiment the percent conversion (% Conv.) to anionic sulfates of the initial nonionic surfactant mix, and the amounts in grams of the initial reactants in the partial sulfation, the total surfactant premix (Total Surf. Premix), i.e, the total product of the partial sulfation, and the specific nonionic and anionic surfactants contained in such premix.

TABLE I

Preparation of Surfactant Premix (Exp. 1–5)

| Experiment | 1 | 2 | 3 | 4 | 5 |
|---|---|---|---|---|---|
| % Conv. | 40 | 45 | 50 | 55 | 60 |
| Initial Reactants | | | | | |
| Non Surf. (1) | 93.94 | 92.80 | 91.70 | 90.61 | 89.56 |
| Non Surf. (2) | 62.62 | 61.87 | 61.13 | 60.41 | 59.71 |
| $H_2SO_4$ | 27.20 | 32.98 | 38.62 | 44.12 | 49.50 |
| Total Surf. Premix | 183.76 | 187.65 | 191.44 | 195.15 | 198.77 |
| Non Surf. (1) | 59.70 | 55.23 | 50.59 | 45.87 | 40.99 |
| Non Surf. (2) | 39.76 | 36.79 | 33.72 | 30.54 | 27.40 |
| An. Surf. (1) | 52.22 | 59.26 | 66.37 | 73.54 | 80.74 |
| An. Surf. (2) | 32.08 | 36.36 | 40.75 | 45.20 | 49.64 |

Liquid detergent compositions were prepared by mixing varying amounts of soft water (Initial Water), 50 wt. % aqueous NaOH (NaOH, 50%), and partially sulfated surfactant premix (Surf. Premix) containing varying amounts of the two nonionic and two anionic surfactants as shown in Table I; 2.50 grams of an unneutralized copolymer of about 90 wt. % of acrylic acid and about 10 wt. % of maleic acid having a number average molecular weight of about 3000, as a soil antiredeposition agent; and 4.12 grams of a 40% slurry of optical brightener (UNPA) in water, to obtain an intermediate aqueous composition having a pH of about 8–9. A small varying amount of either 50 wt. % (Experiments 1, 3, 4 and 5) or 58 wt. % (Experiment 2) of aqueous NaOH (Add. NaOH) was added to raise the pH of the intermediate composition (Int. pH), and 80 grams of an aqueous solution of 25 wt. % of sodium carbonate (dense soda ash), 0.03 gram of dye (150 SGR), 1.29 grams of perfume, and varying amounts of additional soft water (Add.

Water) were added to the composition to bring the batch of finished liquid detergent composition to 1000 grams, after which the final pH of the composition and its viscosity at 76–77° were determined.

Table II shows for each experiment the amounts in grams of those components utilized at each stage of the preparation of the liquid detergent composition, which amounts were varied among the experiments, the pH of the intermediate and final compositions and the viscosity of the final composition.

TABLE II

Components and Viscosities of Liquid Detergent Composition (Exps. 1–5)

| Experiment | 1 | 2 | 3 | 4 | 5 |
|---|---|---|---|---|---|
| Initial Water | 648.41 | 636.86 | 625.59 | 614.59 | 603.84 |
| NaOH, 50% | 29.82 | 37.55 | 45.02 | 52.32 | 59.45 |
| Surf. Premix | 183.76 | 187.65 | 191.44 | 195.15 | 198.77 |
| Add. NaOH | 2.62 | 2.51 | 1.71 | 1.90 | 2.23 |
| Int. pH | 9.66 | 10.7 | 9.46 | 9.48 | 10.3 |
| Add. Water | 47.38 | 47.49 | 48.29 | 48.10 | 47.77 |
| Final pH | 11.10 | 11.05 | 11.02 | 10.91 | 10.74 |
| Viscosity, cps. | 89.0 | 179 | 496 | 784 | 830 |

The percent conversions of the nonionic surfactant to sulfated anionic surfactants shown in Table I and the viscosities of the liquid detergent compositions shown in Table II indicate that with respect to the type of liquid detergent composition exemplified in Experiments 1–5, i.e., those containing a blend of nonionic and anionic surfactants produced by partially sulfating the nonionic surfactants, as contemplated under the invention, at a constant ratio or split of first nonionic surfactant to second nonionic surfactant and varying percent conversions of nonionic to sulfated anionic surfactants, the viscosity of the detergent increases as the percent conversion to sulfates increases.

Experiments 6–10

The procedure of Experiments 1–5 was followed except that the weight ratio or split of the first nonionic surfactant to the second nonionic surfactant, was varied while the percent conversion of the partial sulfation of nonionic surfactants was held constant at about 50%. Table III shows for each experiment the weight ratio or split of the first to the second nonionic surfactants and similar to Table I, the amounts in grams of the initial reactants in the partial sulfation reaction, the total surfactant premix, i.e., the total product of the partial sulfations, and the specific nonionic and anionic surfactants contained in such premix.

TABLE III

Preparation of the Surfactant Premix (Exp. 6–10)

| Experiment | 6 | 7 | 8 | 9 | 10 |
|---|---|---|---|---|---|
| Split | 30/70 | 40/60 | 50/50 | 60/40 | 70/30 |
| Initial Reactants | | | | | |
| Non. Surf. (1) | 46.48 | 61.69 | 76.76 | 91.70 | 106.50 |
| Non Surf. (2) | 108.85 | 92.53 | 76.76 | 61.13 | 45.64 |
| $H_2SO_4$ | 34.70 | 36.02 | 37.32 | 38.62 | 39.90 |
| Total Surf. Premix | 189.63 | 190.24 | 190.84 | 191.44 | 192.04 |
| Non Surf. (1) | 25.39 | 33.84 | 42.18 | 50.59 | 58.88 |
| Non Surf. (2) | 59.25 | 50.70 | 42..18 | 33.73 | 25.27 |
| An. Surf. (1) | 33.32 | 44.36 | 55.45 | 66.37 | 77.31 |
| An. Surf. (2) | 71.67 | 61.34 | 51.03 | 40.75 | 30.58 |

Liquid laundry detergent compositions were prepared following the procedure and using the components described for Experiments 1–5 hereinbefore except that the surfactant premixes shown in Table III were used as the surfactant blends in place of those shown in Table I and the amounts of water and 50 wt. % NaOH (the concentration of all the NaOH solutions in this series of experiments) were somewhat different from those utilized in Experiments 1–5. Table IV shows for each experiment the amounts in grams of components which varied among the experiments, the pH's of the intermediate and final compositions, and the viscosities of the final composition.

TABLE IV

Components and Viscosities of Liquid Detergent Compositions (Exps. 6–10)

| Experiment | 6 | 7 | 8 | 9 | 10 |
|---|---|---|---|---|---|
| Initial Water | 631.97 | 629.82 | 627.70 | 625.59 | 623.50 |
| NaOH, 50% | 40.46 | 42.00 | 43.52 | 45.02 | 46.52 |
| Surf. Premix | 189.63 | 190.24 | 190.84 | 191.44 | 192.04 |
| Add. NaOH | 1.81 | 1.71 | 1.75 | 1.95 | 1.77 |
| Int. pH | 9.3 | 9.15 | 10.1 | 9.5 | 10.2 |
| Add. Water | 48.19 | 48.29 | 48.25 | 48.05 | 48.23 |
| Final pH | 10.89 | 10.80 | 10.75 | 10.58 | 10.68 |
| Viscosity, cps. | 392 | 723 | 826 | 368 | 148 |

The weight ratio or split of the first to the second nonionic surfactants shown in Table III and the viscosities of the liquid detergent compositions shown in Table IV indicate that with respect to the type of detergent compositions described in the experiments and contemplated under the invention, at a constant percent conversion of nonionic to sulfated anionic surfactants and varying ratios or splits of first and second nonionic surfactants from lower to higher values, the viscosity of the detergent composition increases from relatively low split values to a maximum at an intermediate split, e.g. about 50/50, and then decreases at relatively high split values.

The viscosities shown in Tables II and IV when compared with the values of percent conversion and split shown in Tables I and III establishes correlations between the percent conversion and split of the nonionic surfactants on one hand and the viscosity of the liquid detergent composition containing the contemplated type of surfactant blend on the other. Thus, a detergent composition with a viscosity close to a desired range can be obtained by referring to such preestablished correlations and utilizing values of percent conversion and split consistent with such correlations. It can therefore be determined from the previously discussed correlations established by the viscosity data in Tables II and IV that liquid detergent compositions under this invention which are particularly important, i.e., those readily pourable at room temperature either without the addition of any viscosity control agents such as hydrotropes or water soluble high polymers, e.g., having a number average molecular weight of at least 50,000, or with the addition of relatively small amounts of these additives. Thus, compositions having a viscosity at 76–77° F. of, for example, about 40 to about 200 cps., can be obtained when the percent conversion to sulfates of the partial sulfation reaction is from about 40 to about 45% and the weight ratio or split of first to second nonionic surfactants is from about 30/70 to about 35/65 or from about 60/40 to about 70/30, or when the percent conversion is about 45 to about 50% and the split is about 65/35 to about 70/30. In particular, it can be seen from the results of Tables I to IV that detergent compositions having a viscosity at 76–77° F. of about 40 to about 200 cps. can be obtained if the first nonionic surfactant contains an average of about 3 ethoxy groups per molecule, the second nonionic surfactant contains an average of about 7 ethoxy groups per molecule, and the percent conversion is about 40 to about 45% at a weight ratio or split of 60/40, or if the percent conversion is about 50% at a weight ratio or split of 70/30.

For various purposes, it may be desirable to produce a liquid laundry detergent having a viscosity at 76–77° F. of higher than about 200 cps., e.g., when it is desired to add the composition to a wash by a method other than simple pouring such as by use of a squeeze bottle or as an aerosol under pressure. In such cases, a detergent composition having a viscosity within a range higher than 200 cps. at 76–77° F. may also be obtained by determining the split and percent conversion which will result in such higher viscosity, by reference to preestablished correlations such as those indicated in Tables I to IV.

We claim:

1. A process of producing a liquid laundry detergent composition having a viscosity within a desired range comprising dissolving in water a water-soluble builder and a surfactant blend comprising two nonionic and two anionic surfactants, said surfactant blend being prepared by partially sulfating and subsequently neutralizing a mixture prepared by admixing two separate ethoxylated long chain alcohol nonionic surfactants, the first nonionic surfactant containing an average of about 1 to about 5 ethoxy groups per molecule and the second nonionic surfactant containing an average of about 6 to about 12 ethoxy groups per molecule, the weight ratio of first to second nonionic surfactant and the percent conversion of nonionic to sulfated anionic surfactants resulting from the partial sulfation being determined by reference to and consistent with preestablished correlations of said ratio and percent conversion with the viscosity of a liquid laundry detergent composition comprising said builder and surfactant blend, said correlations indicating that when the percent conversion is increased from lower to higher values at a constant value of said ratio, the viscosity of the detergent composition increases with the percent conversion, and that when said ratio is increased from lower to higher values at a constant percent conversion, the viscosity of the detergent composition rises and reaches a maximum at an intermediate ratio and then falls as the ratio is increased further.

2. The process of claim 1 wherein said water-soluble builder is selected from the group consisting of the ammonium and alkali metal carbonates, bicarbonates, sesquicarbonates, orthophosphates, tripolyphosphates, pyrophosphates, hexametaphosphates, borates, silicates, and citrates.

3. The process of claim 2 wherein said builder is sodium or potassium carbonate, bicarbonate, or sesquicarbonate.

4. The process of claim 3 wherein said builder comprises sodium carbonate alone or in admixture with a minor amount of sodium bicarbonate.

5. The process of claim 1 wherein said builder is present in an amount of from about 0.5 to about 12 wt. % based on the weight of the detergent composition.

6. The process of claim 1 wherein said first nonionic surfactant has the formula $$R—O(CH_2CH_2O)_x—H$$

where R is one or more primary or secondary alkyl groups, each having about 10 to about 16 carbon atoms, and x is an average of about 1 to about 5; said second nonionic surfactant has the formula $$R^1O(CH_2CH_2O)_y—H$$

wherein $R^1$ is one or more primary or secondary alkyl groups each having from about 10 to about 16 carbon atoms, and y is an average of about 6 to about 12; the first anionic surfactant has the formula $$R—O—(CH_2CH_2O)_x—SO_3M;$$

and the second anionic surfactant has the formula $$R^1—O—(CH_2CH_2O)_y—SO_3M$$

where R, $R^1$, x and y are as defined hereinbefore, and M is an alkali metal or ammonium cation.

7. The process of claim 6 wherein R is at least one straight chain alkyl group having about 12 to about 14 carbon atoms, x is about 3, $R^1$ is at least one straight chain alkyl group having about 12 to about 16 carbon atoms and y is about 7.

8. The process of claim 7 wherein said preestablished correlations are indicated by the data involving said weight ratio of nonionic surfactants, percent conversion of said partial sulfation reaction, and viscosity of detergent compositions shown in Tables I to IV as supported by the descriptions in Experiments 1–10 of the specification.

9. The process of claim 1 wherein said surfactant blend is present in an amount of about 5 to about 60 wt. % based on the weight of the detergent composition and each nonionic and anionic surfactant is present in an amount of about 5 to about 55 wt. % based on the weight of the surfactant blend.

10. The process of claim 1 wherein said partial sulfation is carried out by admixing said mixture of nonionic surfactants having the desired weight ratio or split of said first to said second nonionic surfactant with 96–100% concentrated sulfuric acid, in a proportion of about 0.5 to about 2 moles of sulfuric acid per mole of nonionic surfactant mixture, and maintaining the resulting exothermic reaction admixture at a temperature between about 90° to about 150° F. for a sufficient period between about 0.5 to about 45 minutes to convert about 30 to about 80 weight percent of the initial nonionic surfactant mixture to sulfate ester anionic surfactants.

11. The process of claim 1 wherein said composition comprises from about 30 to about 95 wt. % of water.

* * * * *